US009222659B2

(12) United States Patent
Medendorp, Jr. et al.

(10) Patent No.: US 9,222,659 B2
(45) Date of Patent: Dec. 29, 2015

(54) LED LAMP

(71) Applicant: Cree, Inc., Durham, NC (US)

(72) Inventors: Nicholas William Medendorp, Jr., Raleigh, NC (US); Randall Levy Bernard, Cary, NC (US); James Michael Lay, Apex, NC (US); Nathan Ray Snell, Raleigh, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 148 days.

(21) Appl. No.: 13/943,152

(22) Filed: Jul. 16, 2013

(65) Prior Publication Data

US 2015/0003069 A1 Jan. 1, 2015

Related U.S. Application Data

(60) Provisional application No. 61/840,652, filed on Jun. 28, 2013.

(51) Int. Cl.

| | |
|---|---|
| ***F21V 29/00*** | (2015.01) |
| ***F21K 99/00*** | (2010.01) |
| *F21V 3/02* | (2006.01) |

(52) U.S. Cl.

CPC ..... *F21V 29/002* (2013.01); *F21K 9/17* (2013.01); *F21K 9/175* (2013.01); *F21K 9/58* (2013.01); *F21V 3/02* (2013.01)

(58) Field of Classification Search

USPC ..... 362/249.02, 311.02, 647, 649, 651, 254

See application file for complete search history.

(56) References Cited

U.S. PATENT DOCUMENTS

| | | | |
|---|---|---|---|
| 5,688,042 | A | 11/1997 | Madadi et al. |
| 6,305,109 | B1 | 10/2001 | Lee |
| 6,853,151 | B2 | 2/2005 | Leong et al. |
| 6,860,628 | B2 | 3/2005 | Robertson et al. |
| 6,936,968 | B2 | 8/2005 | Cross et al. |
| 7,048,410 | B2 | 5/2006 | Kutler |
| 7,049,761 | B2 | 5/2006 | Timmermans et al. |
| 7,114,830 | B2 | 10/2006 | Robertson et al. |

(Continued)

FOREIGN PATENT DOCUMENTS

| | | | |
|---|---|---|---|
| JP | H08162677 | A | 6/1996 |
| JP | 2007059930 | A | 3/2007 |

(Continued)

OTHER PUBLICATIONS

U.S. Appl. No. 29/467,949, filed Sep. 25, 2013.

(Continued)

*Primary Examiner* — Laura Tso

(74) *Attorney, Agent, or Firm* — Dennis J. Williamson; Moore & Van Allen PLLC

(57) ABSTRACT

A lamp comprises an enclosure that is at least partially optically transmissive. The enclosure comprises an optically transmissive lens and a base where the lens is connected to the base; and a LED board supporting an LED. A first of pins and a second pair of pins are rotatable relative to the enclosure and are in the electrical path supplying power to the LEDs. The lamp is positioned between a pair of tombstone connectors such that the first pair of pins engages the first tombstone connector and the second pair of pins engages the second tombstone connector. The first and second pair of pins are inserted into the tombstone connectors and are rotated to engage the electrical connectors in the tombstone connectors.

34 Claims, 20 Drawing Sheets

(56) References Cited

U.S. PATENT DOCUMENTS

| | | | |
|---|---|---|---|
| 7,307,391 | B2 | 12/2007 | Shan |
| 7,510,299 | B2 | 3/2009 | Timmermans et al. |
| 7,815,338 | B2 | 10/2010 | Siemiet et al. |
| 7,926,975 | B2 | 4/2011 | Siemiet et al. |
| 7,976,196 | B2 | 7/2011 | Ivey et al. |
| 8,058,659 | B2 | 11/2011 | Bisberg |
| 8,093,823 | B1 | 1/2012 | Ivey et al. |
| 8,115,411 | B2 | 2/2012 | Shan |
| 8,118,447 | B2 | 2/2012 | Simon et al. |
| 8,214,084 | B2 | 7/2012 | Ivey et al. |
| 8,247,985 | B2 | 8/2012 | Timmermans et al. |
| 8,282,247 | B2 | 10/2012 | Ivey et al. |
| 8,324,817 | B2 | 12/2012 | Ivey et al. |
| 8,360,599 | B2 | 1/2013 | Ivey et al. |
| 8,362,710 | B2 | 1/2013 | Langovsky |
| 8,382,327 | B2 | 2/2013 | Timmermans et al. |
| 8,419,223 | B2 | 4/2013 | Withers |
| 8,421,366 | B2 | 4/2013 | Palazzolo et al. |
| 8,449,137 | B2 | 5/2013 | Dassanayake et al. |
| 8,482,212 | B1 | 7/2013 | Ivey et al. |
| 8,573,813 | B2 | 11/2013 | Ivey et al. |
| 8,596,813 | B2 | 12/2013 | Ivey |
| 2002/0060526 | A1 | 5/2002 | Timmermans et al. |
| 2006/0126325 | A1* | 6/2006 | Lefebvre et al. ..... 362/217 |
| 2010/0103664 | A1 | 4/2010 | Simon et al. |
| 2011/0051413 | A1 | 3/2011 | Hand |
| 2011/0085335 | A1* | 4/2011 | Osawa ..... 362/249.14 |
| 2012/0043884 | A1 | 2/2012 | Lee et al. |
| 2012/0051038 | A1* | 3/2012 | Yue et al. ..... 362/218 |
| 2012/0099322 | A1* | 4/2012 | Simon et al. ..... 362/249.02 |
| 2012/0169234 | A1* | 7/2012 | Shew ..... 315/88 |

FOREIGN PATENT DOCUMENTS

| | | | |
|---|---|---|---|
| JP | 2008288183 | A | 11/2008 |
| JP | 2009117346 | A | 5/2009 |
| JP | 3153766 | U | 9/2009 |
| JP | 2009277586 | A | 11/2009 |
| WO | 2010099755 | A1 | 9/2010 |

OTHER PUBLICATIONS

U.S. Appl. No. 13/943,152, filed Jul. 16, 2013.
U.S. Appl. No. 13/772,436, filed Feb. 21, 2013.
U.S. Appl. No. 13/943,043, filed Jul. 16, 2013.
U.S. Appl. No. 13/943,376, filed Jul. 16, 2013.
U.S. Appl. No. 13/943,455, filed Jul. 16, 2013.

* cited by examiner

LED LAMP

This application claims benefit of priority under 35 U.S.C. §119(e) to the filing date of U.S. Provisional Application No. 61/840,652, as filed on Jun. 28, 2013, which is incorporated herein by reference in its entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments, a lamp comprises an enclosure at least partially optically transmissive. At least one LED is located in the enclosure and is operable to emit light through the enclosure when energized through an electrical path. A first pair of pins are rotatable relative to the enclosure and are in the electrical path.

The enclosure may comprise a base that is substantially planar. The base may be made of a thermally conductive material and may be in thermal communication with the at least one LED. The base may dissipate heat from the at least one LED to the exterior of the lamp. A plurality of LEDs may extend for substantially the length of the base. The enclosure may comprise an optically transmissive lens. The lens may be connected to the base. The lens may be connected to the base using a snap-fit connection. The lens may diffuse light emitted by the at least one LED. The at least one LED may be mounted on a LED board that provides physical support for the at least one LED and forms part of the electrical path. The LED board may comprise one of MCPCB, FR4, a flex circuit, and a lead frame. The lens and LED board may be connected to the base. The base may comprise a first channel and a second channel where the first-channel and the second channel face one another to receive the LED board. The base may also comprise a third channel and a fourth channel where the third-channel and the fourth channel receive a first edge and a second edge of the lens. A portion of the lens may extend behind the plane of the at least one LED. The lens may extend at least 180 degrees relative to the at least one LED. A width of the lens may be greater than a width of the base. The ratio of a width of a base to the maximum width of the lens may be less than 1. The lens may have a height where the base is disposed in the bottom quarter of the height of the lens. The enclosure may comprise a first end cap and a second end cap. The first end cap and the second end cap may receive the base, the LED board and the lens. The first end cap and the second end cap may be connected to at least one of the base, the LED board and the lens. The first end cap and the second end cap may be connected to at least one of the base, the LED board and the lens using a snap-fit connection. The first end cap and the second end cap may be provided with a deformable member that engages one of the LED board, the lens and the base. The deformable member may engage the LED board when the LED board is inserted into the first end cap and the second end cap. A second pair of pins may be rotatable relative to the enclosure and may be in the electrical path. A first and second pair of conductors may be electrically coupled to the first pair of pins, the second pair of pins and to the electrical path. The first pair of pins and the second pair of pins may be rotatable relative to the enclosure at least 90 degrees. The first pair of pins and the second pair of pins may be mounted on a first member and a second member that are rotatably connected to the end caps.

A method of assembling a LED fixture comprises removing a fluorescent tube from a first tombstone connector and second tombstone connector; providing an LED lamp comprising an enclosure at least partially optically transmissive and at least one LED in the enclosure operable to emit light through the enclosure when energized through an electrical path and a first pair of pins and a second pair of pins mounted to the enclosure, the first pair of pins and the second pair of pins being in the electrical path; positioning the LED lamp between the tombstone connectors such that the first pair of pins engage the first tombstone connector and the second pair of pins engage the second tombstone connector; and rotating the first pair of pins and the second pair of pins relative to the enclosure

DETAILED DESCRIPTION

Figure 1:
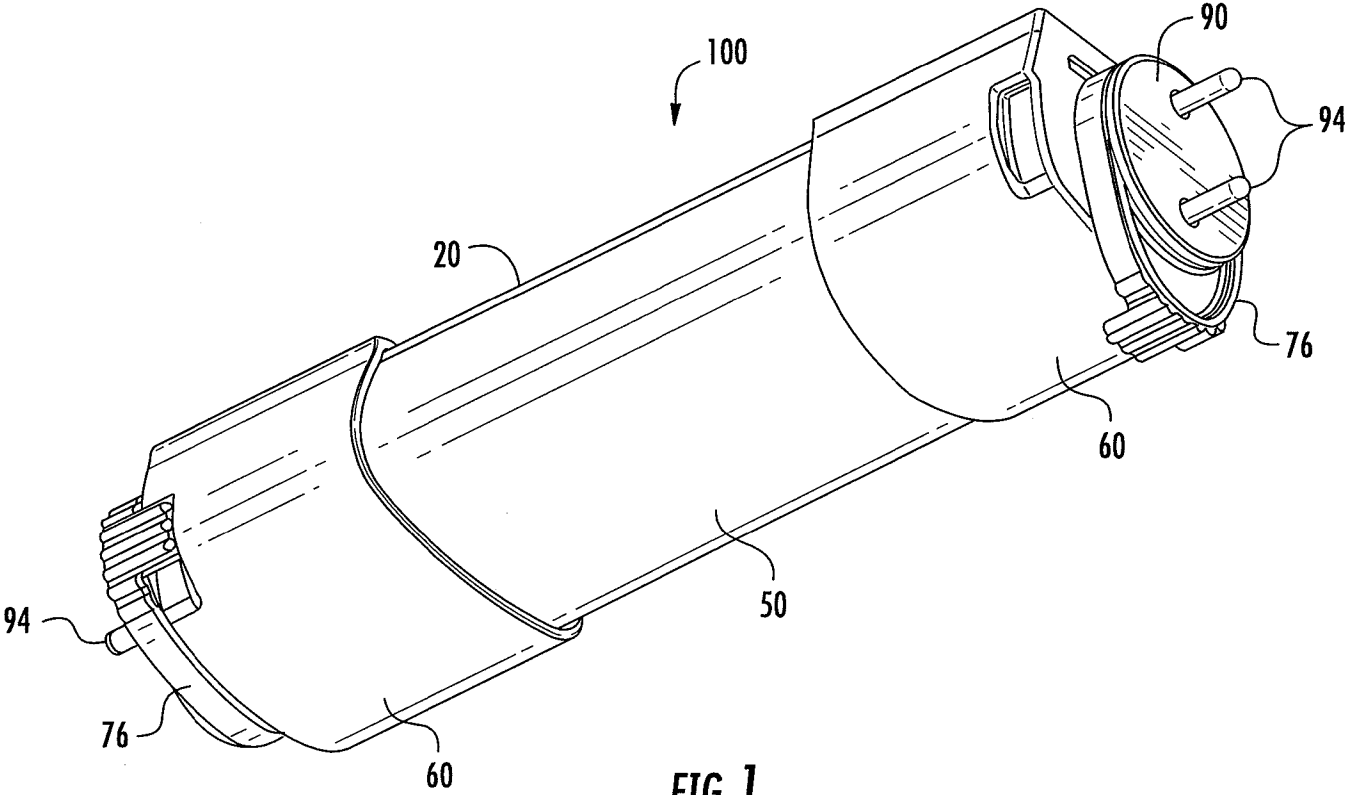
FIG. 1 is a perspective view showing an embodiment of a LED lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Moreover, the various aspects of the embodiments as described herein may be used in combination with any other aspects of the embodiments as described herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 8:
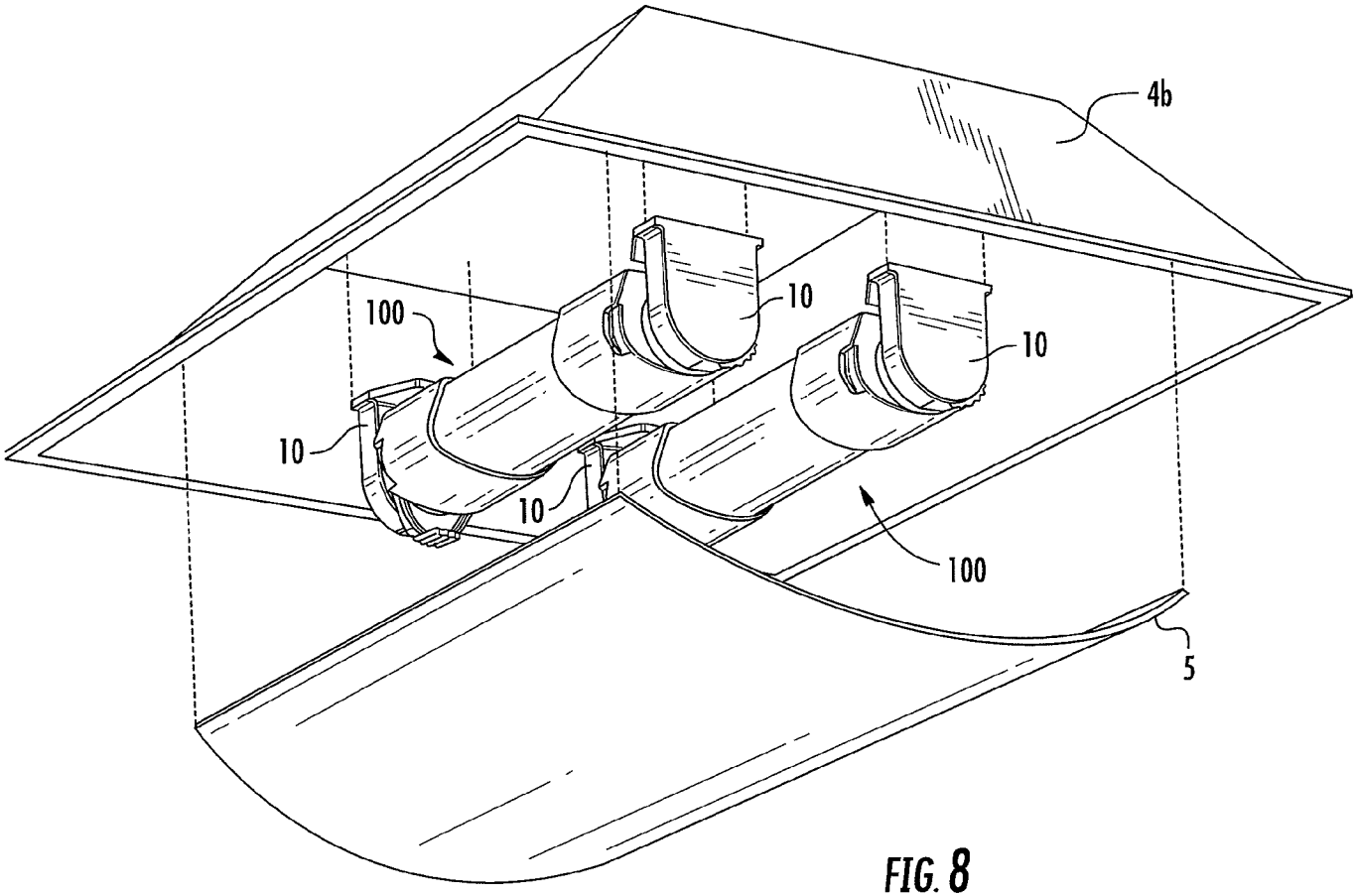
FIG. 8 is an exploded perspective view showing two LED lamps of the invention mounted in tombstone connectors and a troffer housing.
Figure 9:
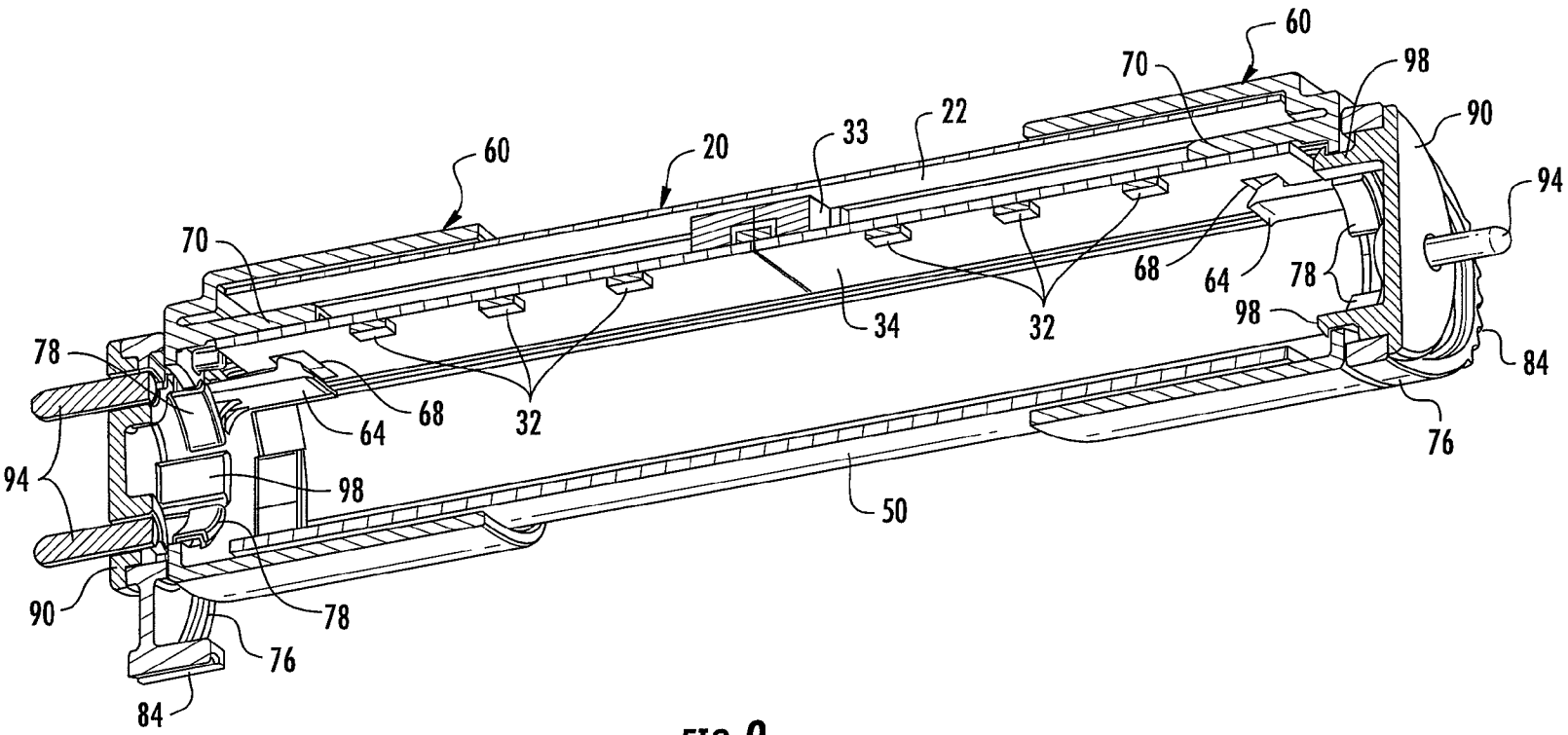
FIG. 9 is a vertical longitudinal section view of the lamp of FIG. 1.
Figure 10:
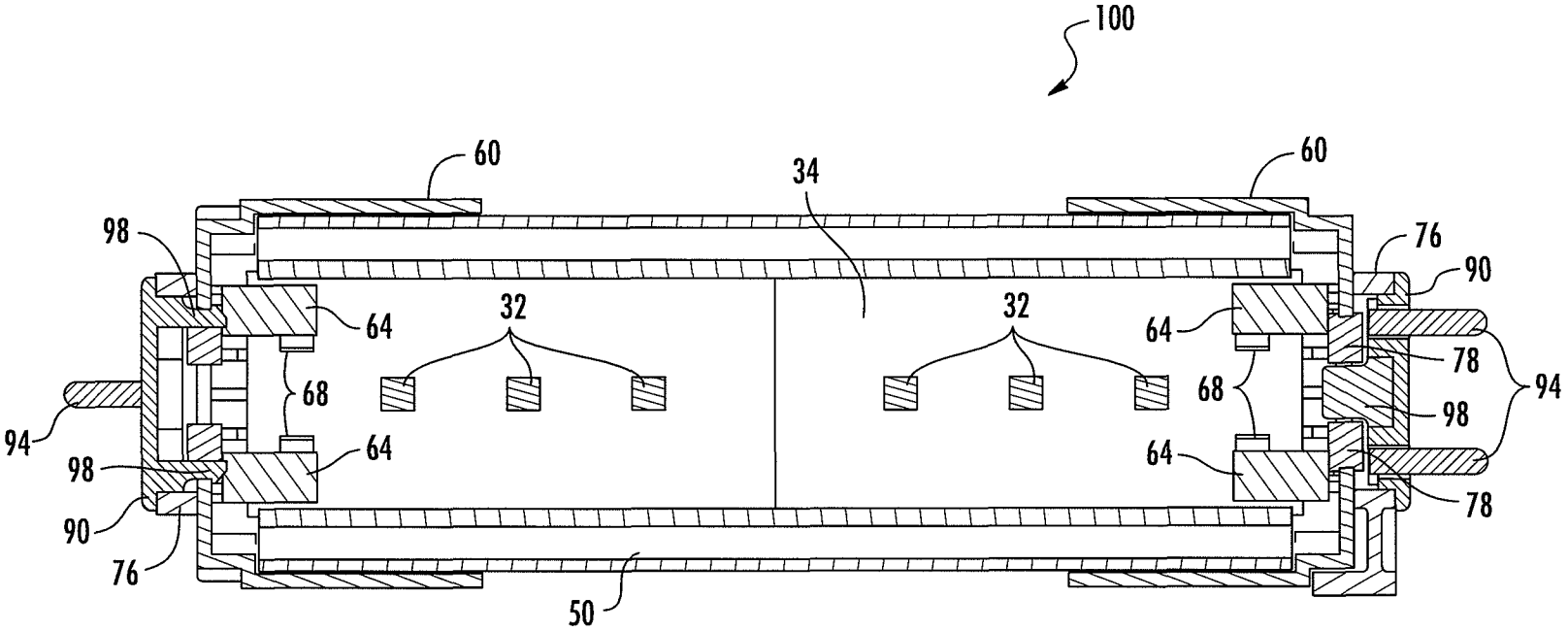
FIG. 10 is a horizontal longitudinal section view of the lamp of FIG. 1.
Figure 11:
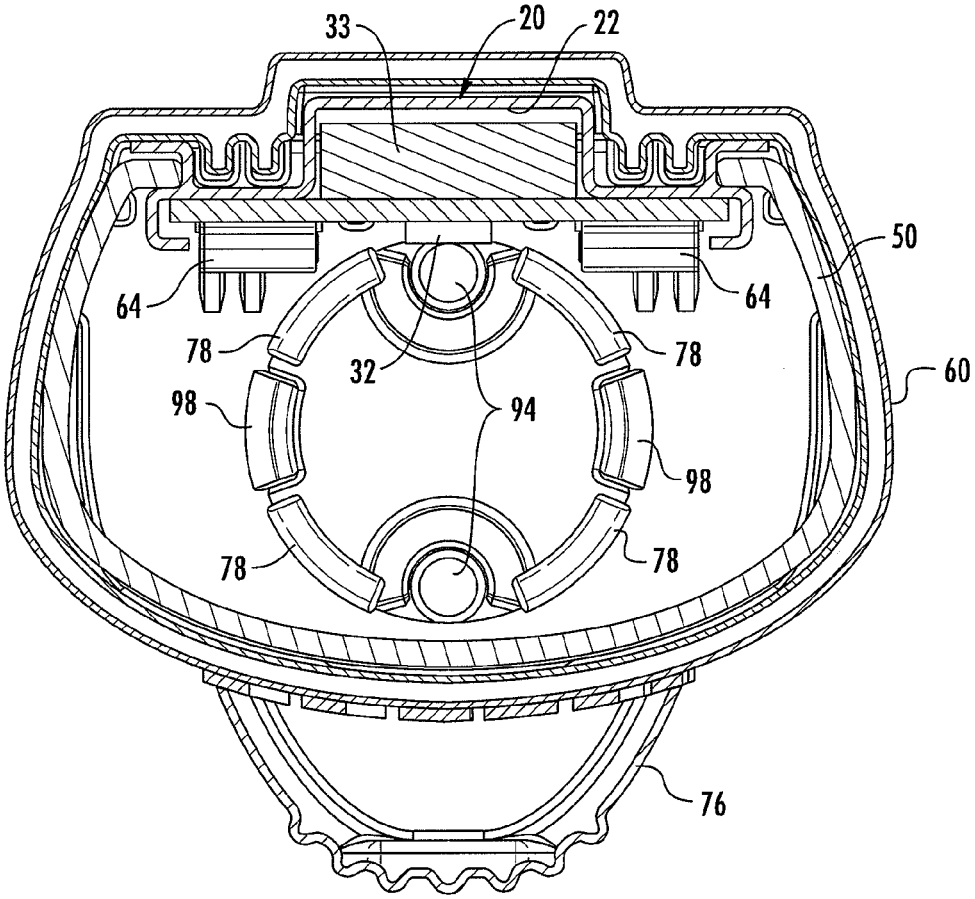
FIG. 11 is a vertical section view of the lamp of FIG. 1 through the end cap.
Figure 12:
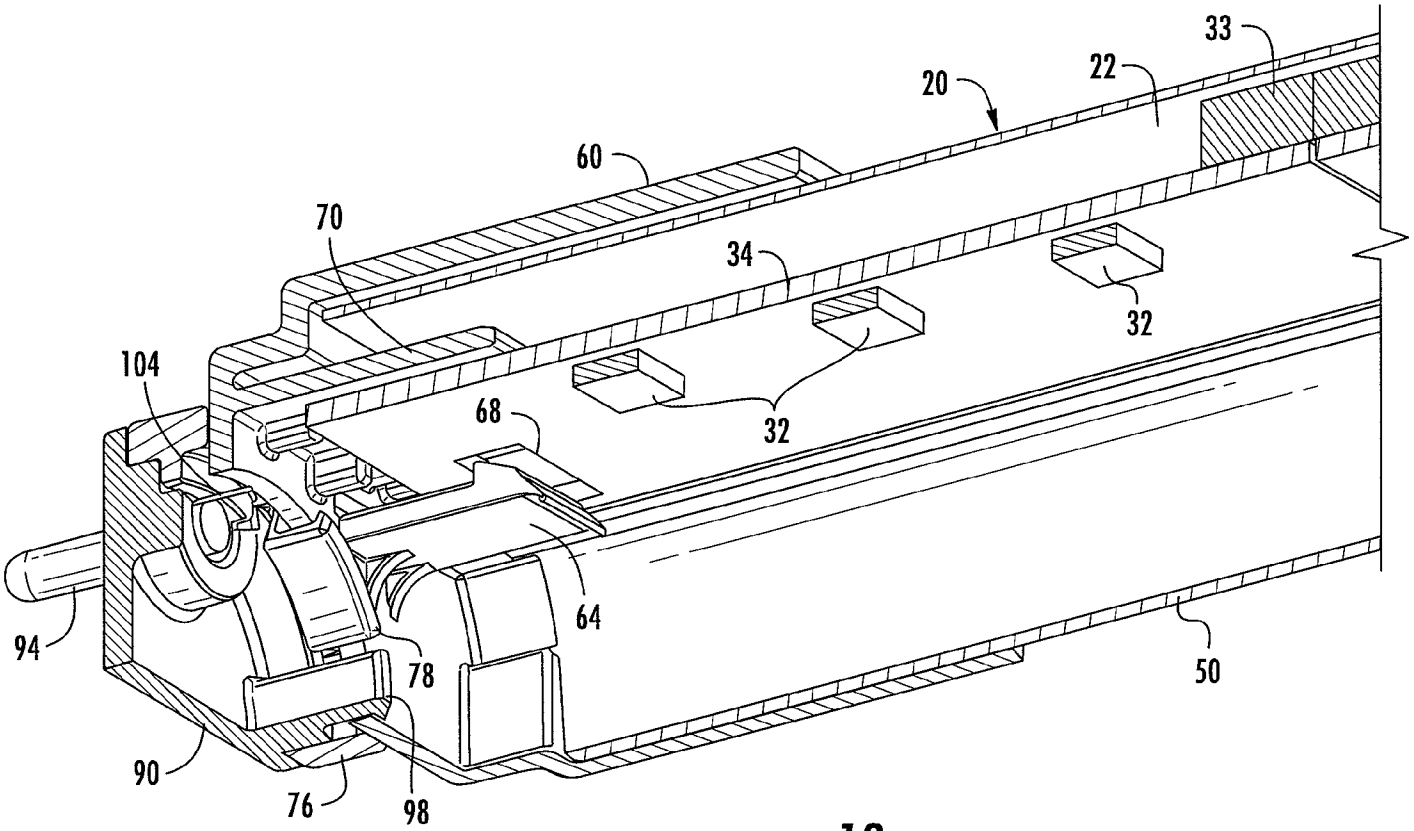
FIG. 12 is a detailed section view of the lamp of FIG. 1.
Figure 13:
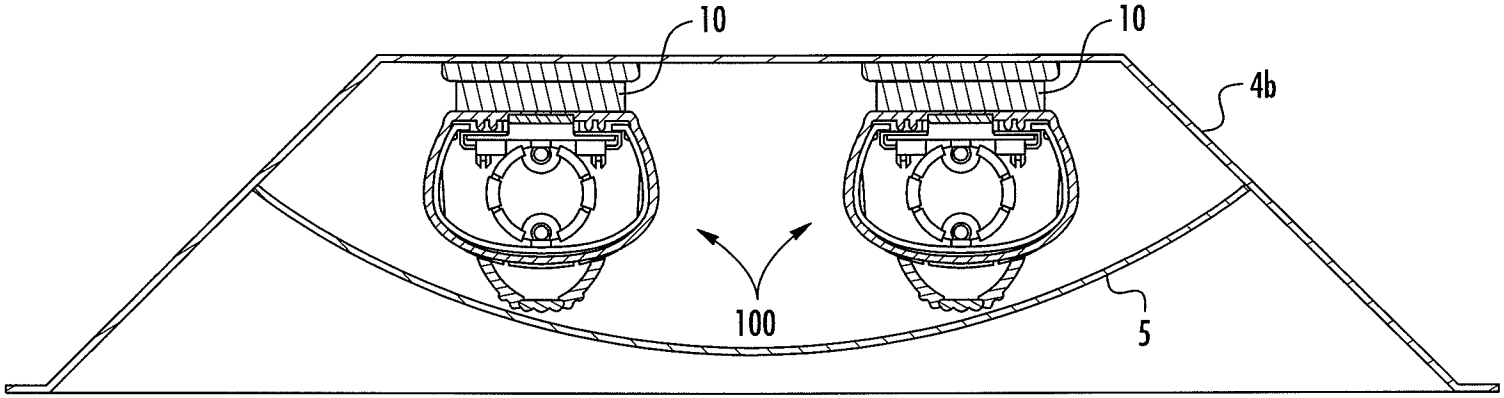
FIG. 13 is a vertical section view of the troffer housing and LED lamps of FIG. 8.
Figure 14:
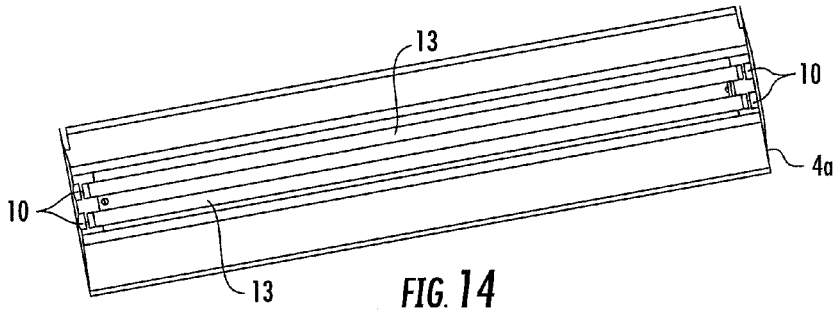
FIGS. 14 and 15 show a troffer housing and fluorescent bulbs useful in explaining the method of assembling a troffer fixture using the LED lamp of the invention.
Figure 15:
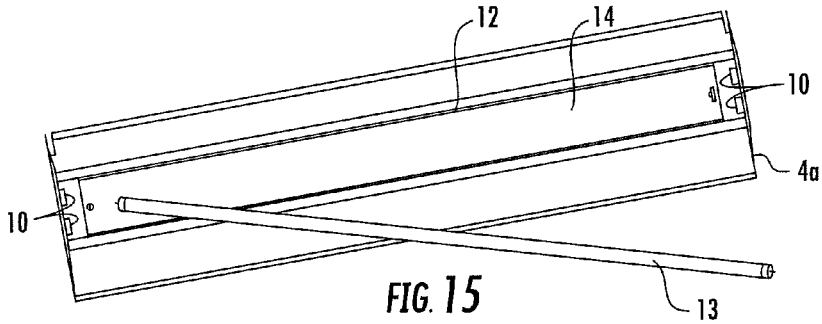

As shown in FIGS. 14 and 15 show one embodiment of a traditional fluorescent troffer fixture having a housing 4*a* that may be recess mounted or flush mounted in a ceiling or other structure. Another embodiment of a fluorescent fixture 4*b* is shown in FIGS. 8 and 13 having a diffuser lens 5. While embodiments of different types of fixtures are shown, the housing in which the lamp of the invention may be used may comprise a variety of shapes, sizes and configurations. The lamp of the invention may be used in any lighting fixture that uses conventional tombstone connectors. The housing typically supports a ballast and electrical conductors such as wiring that comprise the electrical connection between the lamp's tombstone connectors 10 and a power supply. The power supply may be the electrical grid of a building or other structure or the like. The tombstone connectors 10 connect to two pins formed on each end of a fluorescent tube 13 to provide power to the fluorescent tube. Typically, the ballast, wiring and other electrical components are retained in a compartment or wire way 12 in the housing. The wire way 12 typically comprises a recessed area or trough in the base of the housing. The wire way 12 may be covered by a removable wire way cover 14 such that the only exposed electrical components are the UL approved tombstone connectors 10.

Because LED based solid state lamps use less energy, are more durable, operate longer, can be combined in multi-color arrays that can be controlled to deliver virtually any color light, and generally contain no lead or mercury the conversion to, or replacement of fluorescent lighting systems with, LED lighting systems is desired. In some existing replacement lamps the entire fluorescent fixture including the troffer must be replaced. The conversion from a fluorescent light to a solid state LED based light may be time consuming and expensive. In the system of the invention, a traditional fluorescent light may be converted to an LED based solid state lamp quickly and easily by replacing the fluorescent bulb with an LED lamp. The LED lamp fits into the same housing as the fluorescent tube and uses the existing tombstone connectors to provide current to the LED lamp. The LED lamp of the invention allows a traditional fluorescent light to be converted to a solid state LED lamp without requiring specialized tools, equipment or training.

Figure 16:
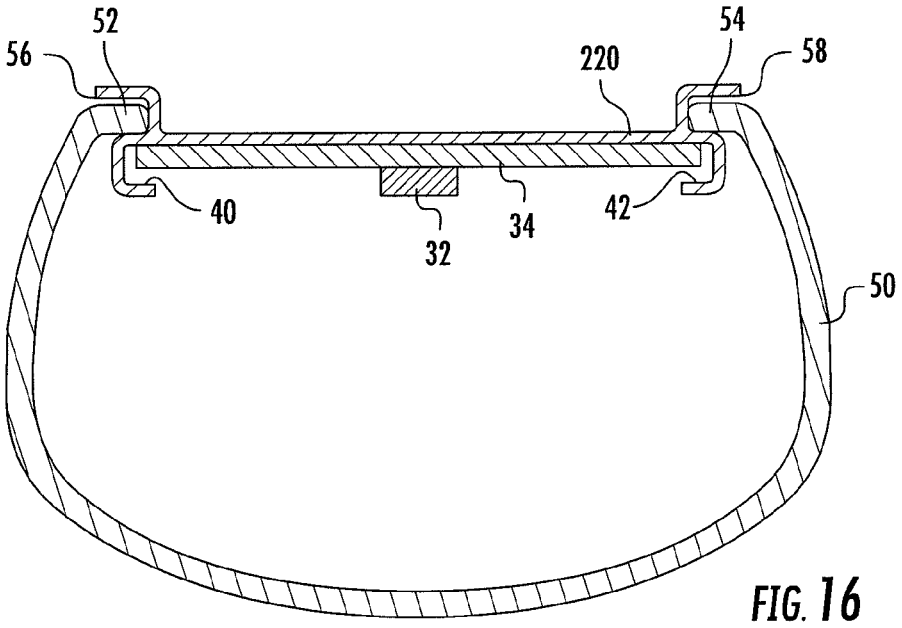
FIGS. 16, 17 and 18 are vertical transverse section views of alternate embodiments of the LED lamp of the invention.
Figure 17:
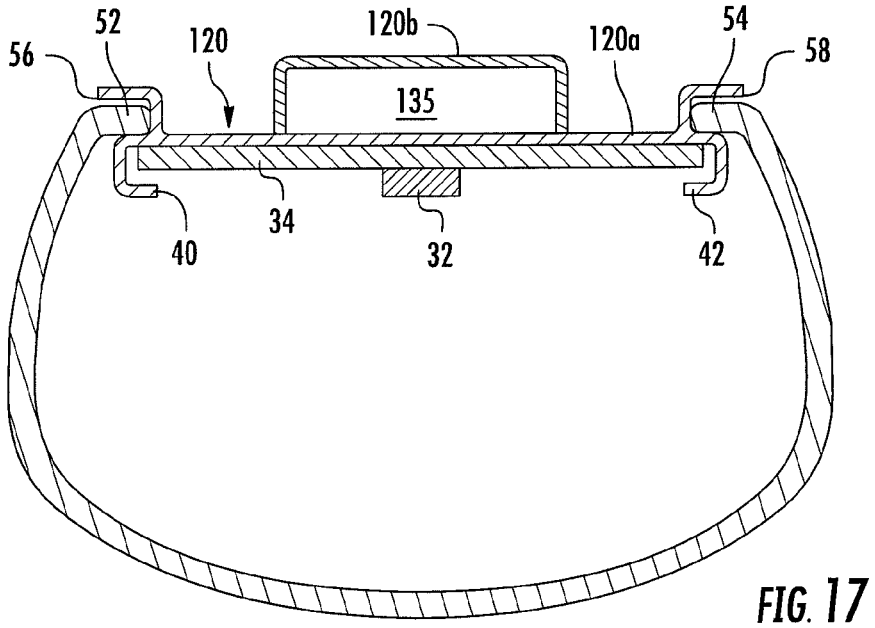
Figure 18:
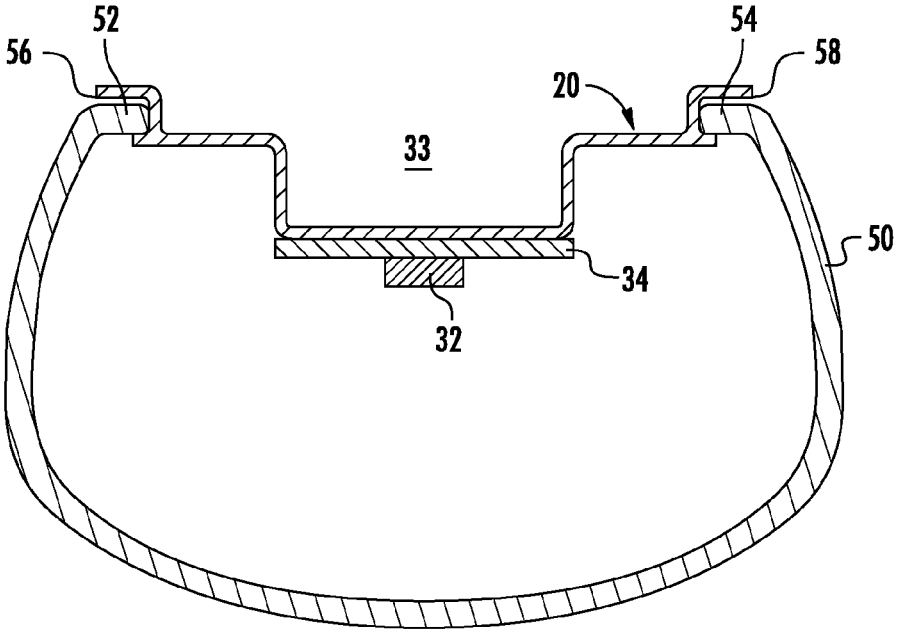
Figure 22:
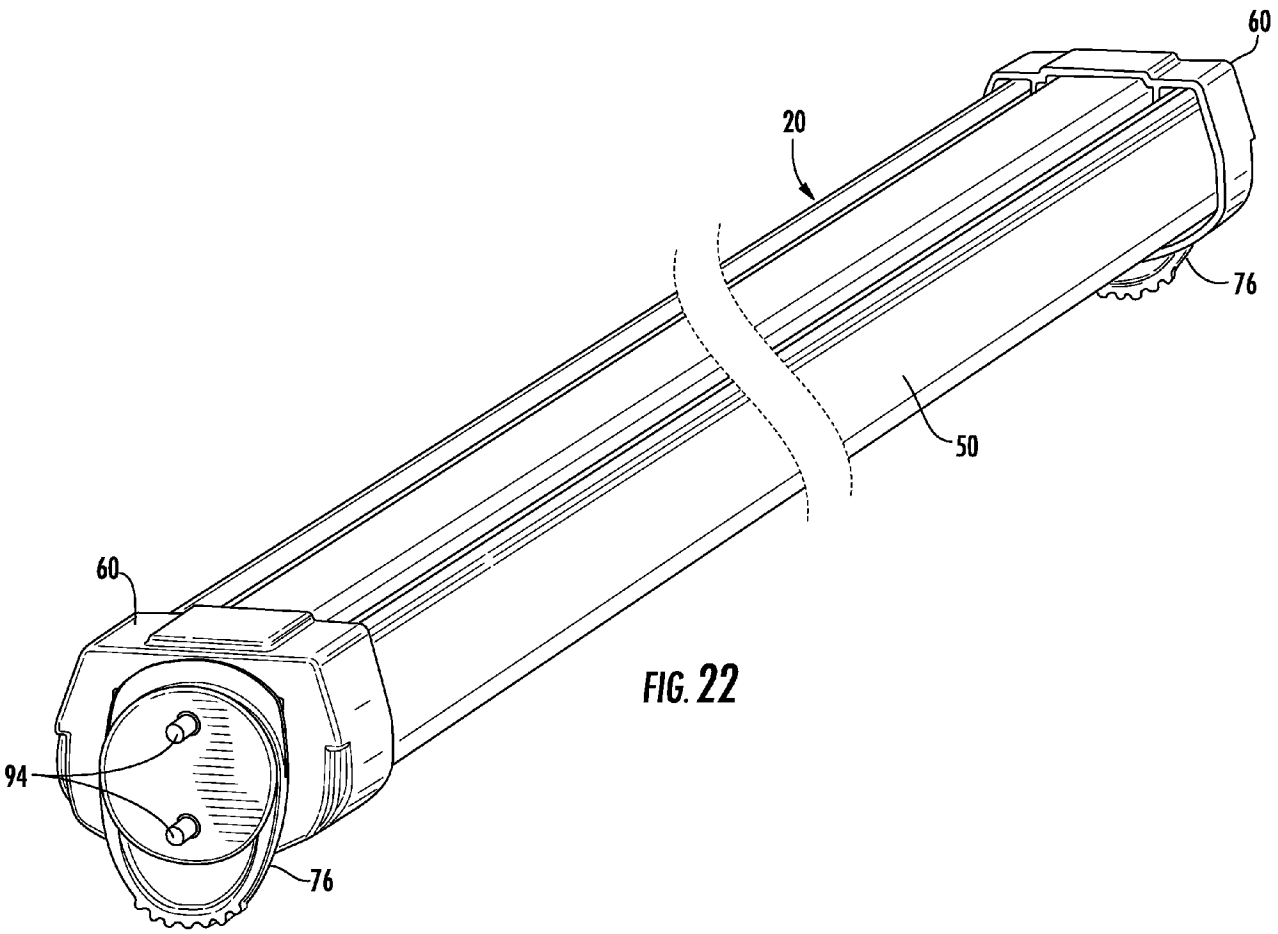
FIG. 22 is a bottom perspective view of an alternate embodiment of the LED lamp of the invention.

In one embodiment the LED lamp 100 comprises a generally planar or flat base 20. The base 20 may be made of a thermally conductive material such that it functions as a heat sink to dissipate heat from the LED assembly. The base 20 may be made of a rigid material to support the LED assembly 30 and lens 50. In some embodiments the base may be made of extruded aluminum. While aluminum may be used, other rigid, thermally conductive materials and manufacturing processes may be used to form the base 20. While the base 20 is described as planar, the base may have surface irregularities such that while the base is generally planar or flat it is not necessarily a true planar surface. For example, in one embodiment the base comprises a flat member formed to have a centrally disposed longitudinally extending rib 22. The rib 22 provides structural rigidity to the base 20 such that the base 20 does not flex or bend. In other embodiments the base 120 may comprise a planar member 120*a* where a separate box member 120*b* is secured to the planar member 120*a* such as by welding, adhesive fasteners or the like. While a rib 22 may be used in some embodiments to add rigidity to the base 20, the base 220 may comprise a planar member without a reinforcement rib, as shown in FIG. 16, where, for example, the thickness of the base provides sufficient rigidity for the lamp. The rib 22 may be formed such that it extends away from the LED assembly 30 such that a chamber 35 may be provided behind the LED assembly 30, between the LED assembly 30 and the base 20. In the embodiment of FIG. 17 chamber 134 is formed between the planar member 120*a* and the box member 120*b*. The chamber 35, 135 may support lamp components such as connectors or the like. In other embodiments the rib 22 may extend to the same side as the LED assembly 30 such that the LED assembly 30 is held in an offset position relative to the remainder of the base 20 as shown in FIG. 18. In the embodiment of FIG. 18 the arrangement of the rib creates an exterior channel 33 that extends along the base and is open to the exterior of the lamp. Any of the bases disclosed herein may be used with any of the translucent lenses disclosed herein. The term planar as used herein to describe the base is intended to define a base that is non-round and that creates a generally flat top surface of the lamp 100. Referring to FIG. 22 the base 20 may be formed with extending fins 23 that create a heat sink to increase the surface area of the base and increase heat transfer to the ambient environment.

The LED lamp 100 comprises an LED assembly 30 that may be supported by and secured to the base 20. The LED assembly 30 may comprise a plurality of LEDs or LED packages 32 that extend the length of, or substantially the length of, the base 20 to create a desired light pattern. The LEDs 32 may be arranged such that the light pattern extends the length of, or for a substantial portion of the length of, the lamp and is similar in length to a traditional fluorescent bulb. While in one embodiment the LEDs 32 extend for substantially the entire length of the base 20, the LEDs 32 may be arranged in other patterns and may extend for less than substantially the entire length of the base if desired. For example, the LEDs may be disposed along the edges of the LED board 34 and directed toward the middle of the lamp. The LEDs may be directed into a waveguide. The LEDs 32 may be mounted on a LED board 34 that provides physical support for the LEDs 32 and provides an electrical path for providing electrical power to the LEDs. The electrical path provides power to the LEDs and may comprise the power source, board 34 and intervening lamp electronics. The board 34 may comprise MCPCB, FR4, a flex circuit, lead frame or other suitable mounting substrate for the LEDs. The board may comprise the electrical components that form part of the electrical path to the LEDs or electrical conductors may comprise separate elements that are supported by the board. In the illustrated embodiments the base 20 and the LED board 34 are shown as separate physical elements; however, the LED board 34 and the base 20 may be a single element where the LED board has the structural integrity to support the lamp components.

The LEDs 32 may be provided in a wide variety of patterns and may include a wide variety of different types and colors of LEDs to produce light in a wide variety of colors and/or light patterns. In some embodiments LEDs as disclosed herein may include one or more light affecting elements (including light transmissive, light-absorptive, light reflective and/or lumiphoric materials) formed on, over or around at least one solid state light emitter including fused elements embodying a plurality of dots, rods, or layers such as may be formed by three-dimensional (3D) printing. Further details regarding formation of light affecting elements including fused elements such as may be formed by 3D printing are disclosed in a related U.S. patent application Ser. No. 13/943,043 entitled "SOLID STATE LIGHTING DEVICES AND FABRICATION METHODS INCLUDING LIGHT-AFFECTING ELEMENTS" by Medendorp et al., filed Jul. 16, 2013, the disclosure of which is incorporated by reference herein in its entirety. In some embodiments, the LED assembly 30 may comprise more than one board where the boards are connected to one another at a connector 33 to provide an electrical path between the individual boards. The connector 33 comprises mating electrical connectors on the boards such that the mating electrical connectors may be connected to create an electrical path along the length of the board. In the illustrated embodiment the connector 33 is shown on the opposite surface of board 34 from the LEDs such that the connector 33 is located in the chamber 35. Alternatively, the connector may be on the same side of the board as the LEDs. One embodiment of a LED lamp and suitable LED structure is shown and described in U.S. patent application Ser. No. 12/873,303 entitled "Troffer-Style Fixture" filed on Aug. 31, 2010, which is incorporated by reference herein in its entirety. Example embodiments of interfacing one or more LEDs to AC-output lighting ballasts are in a related U.S. patent application Ser. No. 13/943,376 entitled "LED LIGHTING APPARATUS FOR USE WITH AC-OUTPUT LIGHTING BALLASTS" by Zhang et al., filed Jul. 16, 2013, the disclosure of which is incorporated by reference herein in its entirety. Example embodiments of interfacing LED strings to fluorescent emergency lighting ballasts are described in a related U.S. patent application Ser. No. 13/943,455 entitled "EMERGENCY LIGHTING CONVERSION FOR LED STRINGS" by McBryde et al., filed Jul. 16, 2013, the disclosure of which is incorporated by reference herein in its entirety.

The board 34 may be supported by the base 20 such that the board 34 and LEDs 32 are supported for the length of the lamp. In one embodiment the base 20 comprises a first inwardly opening C-channel 40 that extends along the length of one side of the base 20 and a second inwardly opening C-channel 42 that extends along the length of the opposite side of the base 20. In one embodiment the channels 40, 42 extend for the length of the base 20; however, the channels 40, 42 may extend for less than the entire length of the base 20 provided that they adequately support and retain the board 34. For example, gaps may be provided in the channels 40, 42. The channels 40, 42 face one another to create a receptacle for receiving the board 34. In one embodiment the longitudinal edges of the board 34 are inserted into the channels 40, 42 such that the board 34 may be retained in the channels 40, 42 and supported on the base 20. The board 34 may be retained by friction, a mechanical engagement, a pressure fit, adhesive, mechanical connector or other connection mechanism. To assemble the board 34 and base 20 the board may be inserted into the channels from one end of the base 20 and slid into engagement with the channels 40, 42. The board 34 is thermally coupled to the base 20 such that heat generated by the LEDs 32 is transferred to the base 20 via the board 34 and is dissipated to the ambient environment by the base 20. The thermal couple between the board 34 and base 20 may be provided by providing surface to surface contact between the board and the base. In other embodiments thermally transmissive layers may be provided between the base and the board. For example, thermal adhesive may be used to attach the board 34 to the base 20.

The LED assembly 30 may be made removable from the base 20 for maintenance purposes or to vary the light output for different applications. The LED assembly 30 may be made removable by attaching the board 34 to the base 20 using a releasable connection mechanism such as, but not limited to, a friction fit or a snap-fit connection, screws or other releasable fasteners or the like. The base 20 and LED assembly 30 may be made of a reflective material, e.g., MCPET, white optic, or the like, to reflect light from the mixing chamber 51. The entire base and/or board may be made of a reflective material or portions of the base and/or board may be made of reflective material. For example, portions of the base and/or board that may reflect light may be made of reflective material.

A lens 50 may be connected to the base 20 to cover the LED assembly 30 and create a mixing chamber 51 for the light emitted from the LEDs 32. The light is mixed in the chamber 51 and the lens 50 diffuses the light to provide a uniform, diffuse, color mixed light pattern. The lens 50 may be made of molded plastic or other material and may be provided with a light diffusing layer. The light diffusing layer may be provided by etching, application of a coating or film, by the translucent or semitransparent material of the lens, by forming an irregular surface pattern during formation of the lens or by other methods. Because the lens has a flattened non-round profile, a greater distance between the LEDs and the lens can be provided than with a round lens having the same height. As a result more optical spreading distance is provided between the lens and the LEDs to provide better mixing.

Figure 2:
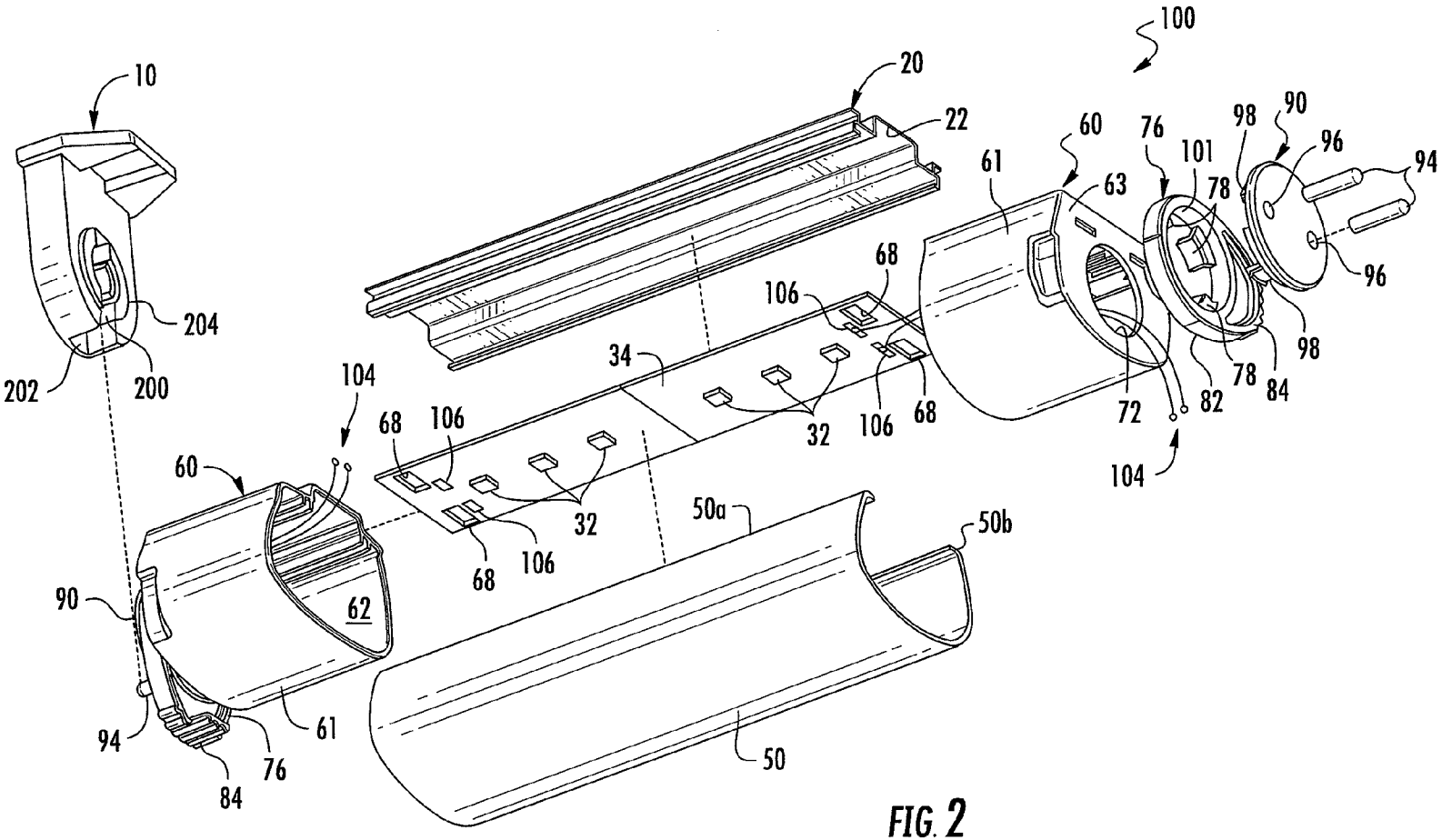
FIG. 2 is an exploded view of the LED lamp of FIG. 1.
Figure 3:
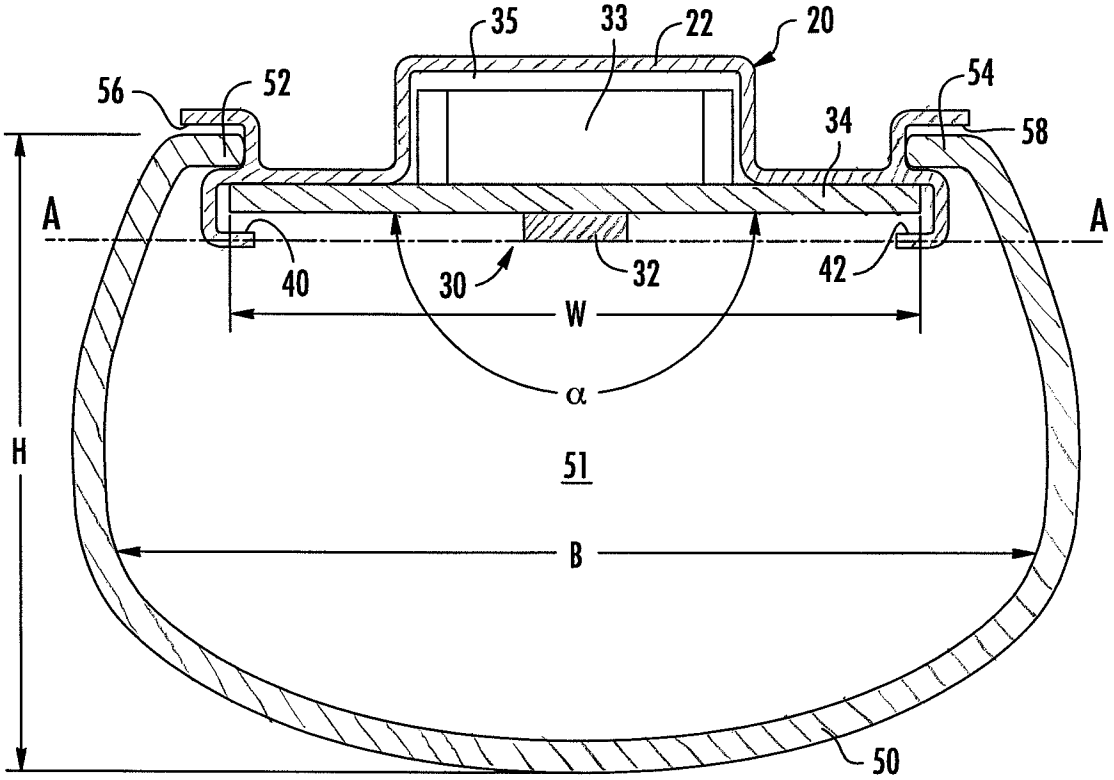
FIG. 3 is a vertical transverse section view of the LED lamp of FIG. 1.

In some embodiments the lens 50 has a dome-shaped cross-sectional profile as shown for example in FIGS. 2 and 3. The lens 50 extends substantially the length of the base 20 to cover the LEDs 32 supported on the base 20. In some embodiments, the longitudinal edges 50*a*, 50*b* of the lens 50 are provided with inwardly facing lips or projections 52 and 54 that may be received in outwardly facing longitudinal C-channels 56, 58 formed along the longitudinal edges of the base 20. The lens 50 and projections 52, 54 may be formed as one piece such as by a plastic molding process. In some embodiments, the base 20 may be formed of extruded, stamped or rolled metal where the channels 56 are formed as one-piece with the base; however, the channels may be separately attached to the base. The projections 52, 54 are inserted into the channels 56, 58 to retain the lens 50 on the base 20. The projections 52, 54 may be slid into the channels 56, 58 from the end of the base 20. If the lens 50 is made of an elastic material, such as molded plastic, the projections 52, 54 may also be inserted into the channels 56, 58 by inserting a first projection 52 into one of the channels 56 and deforming the lens to insert the opposite projection 54 into the opposite channel 58. The lens 50 may then be released such that the lens elastically returns to its original shape where the projections 52, 54 are forced into the opposed channels 56, 58. As shown in the figures in some embodiments the base 20 has a generally planar shape with an S-channel formed along the longitudinal edges thereof. The S-channel defines inwardly facing channels 40, 42 for receiving the board 34 and outwardly facing channels 56, 58 for receiving the projections 52, 54 of lens 50.

As illustrated in the figures the lens 50 is arranged such that the lens 50 extends above or behind the plane A-A of the LEDs 32. Behind as used herein means toward the side of the board opposite the LEDs. In other words, from a point located on the LED 32 the lens 50 extends for an angle $\alpha$ greater than 180 degrees (or greater than 90 degrees in each direction from a line that extends perpendicularly from the LED). In some embodiments the lens 50 may extend at an angle $\alpha$ greater than 215 degrees. In other embodiments, the lens 50 may extend at an angle $\alpha$ greater than 270 degrees. Moreover, to the lateral sides of the LEDs the base and LED board do not include any portions that extend to block light emitted by the LEDs. The planar LED board and base 20 do not obstruct light emitted laterally from the LEDs. As a result of this arrangement some of the light generated by the LEDs 32 is directed as backlight in a direction behind the plane A-A of the LEDs 32. The light is directed toward the light housing 4*a*, 4*b* where it can be reflected by the housing to create a light distribution pattern that is similar to the light distribution pattern of a traditional fluorescent system. It will be understood that in a traditional fluorescent system the fluorescent tube generates light over 360 degrees. As a result, some of the light generated by the fluorescent tube is reflected from the housing. By arranging the lens 50 such that it extends behind the plane A-A of the LEDs 32. Some of the light generated by the LEDs 32 may be emitted directly out of the lamp as backlight while additional light may be reflected off of the lens 50 and emitted as backlight. Such an arrangement provides an LED lighting system that provides a light distribution pattern that is similar to legacy fluorescent tube lights. In some embodiments, the LEDs may be center mounted with greater side emitting optical profiles such as CREE XPQ LEDs. In some embodiments a prismatic lens or parabolic reflectors may be used to create a desired light distribution. In some embodiments the lens 50 may not include side walls such that the lens covers only the bottom of the lamp with the sides of the enclosure open to the external environment.

Further, as shown in FIG. 3 the lens 50, in some embodiments, may be configured such that the width of the lens 50 at its widest portion B is larger than the width W of the base 20. In other words the ratio of the base width W to the maximum lens width B is less than 1. As a result light may be emitted from the lens 50 as backlight that is not blocked by the base 20. The backlight may be reflected from the light housing 4 to create the light distribution pattern described above.

Figure 19:
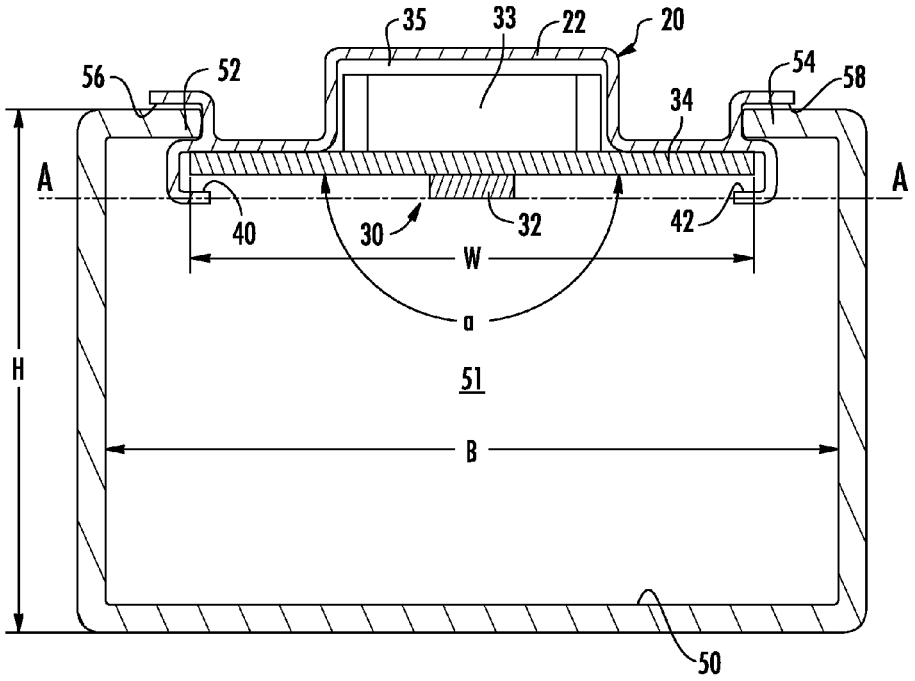
FIGS. 19, 20 and 21 are vertical transverse section views of alternate embodiments of the LED lamp of the invention.
Figure 20:
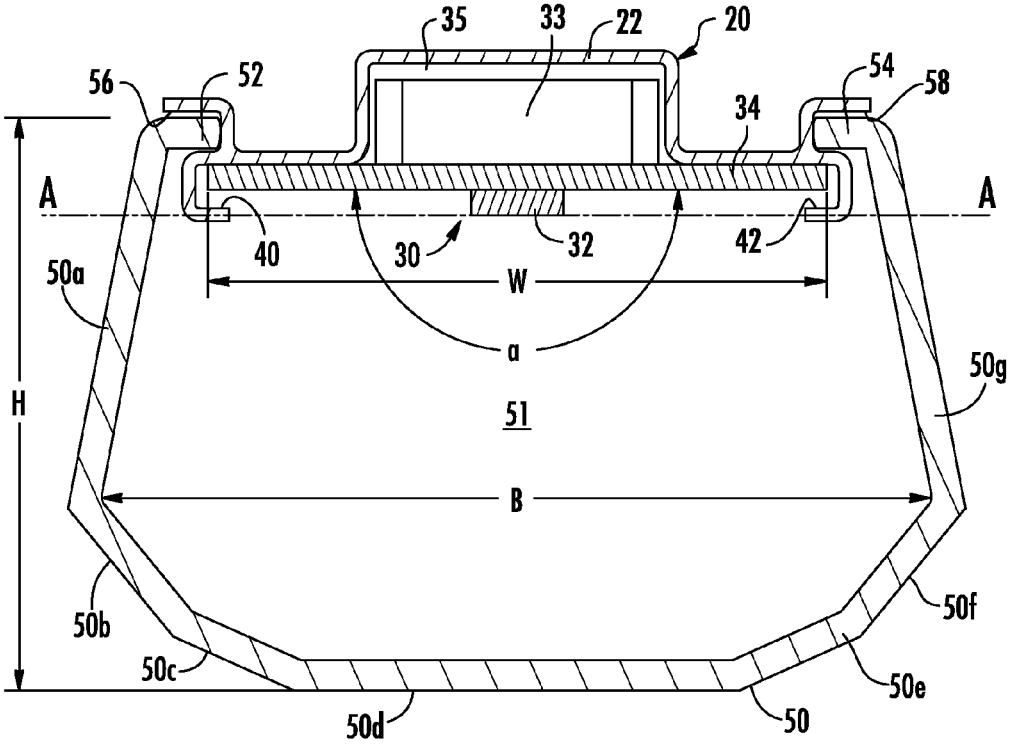
Figure 21:
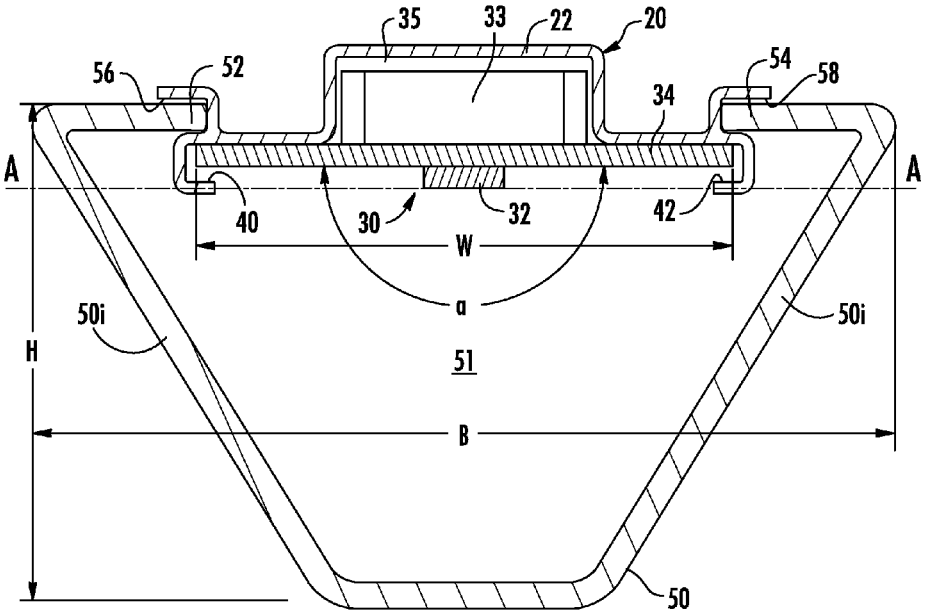

Referring to FIG. 19 an alternate embodiment of the lens 50 is shown where the lens is provided with a cross-sectional profile where the lens has a relatively square or rectangular shape. FIG. 20 illustrates another embodiment of the lens 50 where the lens comprises faceted profile where the lens comprises a plurality of planar surfaces 50*a*-50*g*. The lens may comprise a regular or irregular polygon such and may include a wide variety of number of surfaces such as 4, 5, 6, 7, 8, 9, 10 or more sides. FIG. 21 illustrates another embodiment of the lens 50 where the lens comprises a generally triangular profile. While the illustrate lens terminates a flat face 50*h* that extends generally parallel to the base 20 the lens may terminate in a corner where sides 50*i* meet at an acute angle. The lens is disposed as previously described where the lens 50 extends above or behind the plane A-A of the LEDs 32. Further, as previously explained the width of the lens 50 at its widest portion B is larger than the width W of the base 20. In other words the ratio of the base width W to the maximum lens width B is less than 1. As a result light may be emitted from the lens 50 as backlight that is not blocked by the base 20.

In some embodiments the lens 50 and base 20 are arranged such that the LEDs mounted on the base 20 are disposed in the top 30-35% of the height of the lens and in some embodiments the LEDs mounted on the base 20 are disposed in the top 25% of the height of the lens. Referring to FIG. 3, if the lens has a height of H, then the base 20 and LEDs 32 are disposed between the top of the lamp and a distance 0.25H from the top of the lamp for example. Arranging the LEDs in such a position relative to the overall height of the lamp allows the lens to be disposed such that backlight is created as previously described.

End caps 60 may be provided at the opposite ends of the lens 50 to close the interior mixing chamber 52 of LED lamp 100 and to support the electrical connectors 94 for connecting to the tombstone connectors 10 of the housing. The end caps 60, base 20 and lens 50 together define an enclosure that retains the LEDs 32. The enclosure is partially optically transmissive through the lens 50.

The end caps 60 are identical such that the structure and operation of one end cap will be described. The end cap 60 comprises an internal chamber 62 defined by a side wall 61 and an end wall 63 dimensioned and shaped to closely receive the base 20, LED board 34 and lens 50. In one embodiment the lens 50, LED board 34, and base 20 are slid into the chamber 62 and a snap-fit connection is used to secure the end caps 60 these components. In one embodiment the end cap 60 is provided with two deformable locking members 64 that engage the LED board 34 when the LED board 34 is inserted onto the end cap 60. The locking members 64 are made of resilient material and have a first end connected to the end cap 60 and an engagement member 66 at the free end that engage apertures 68 formed on the LED board 34. The locking members 64 may be deformed by the board 34 as the board is inserted into the chamber 62. To facilitate the deformation of the locking members 64 the ends of the locking members 64 are formed with angled surfaces 65 that are engaged by the board as the board is slid into the end cap 60. When the apertures 68 are aligned with the engagement members 66 the locking members 64 return to the undeformed locking position such that the engagement members 66 are biased into engagement with the apertures 68. The engagement of the engagement members 66 with the side walls of the apertures 68 secures the end cap 60 to the board 34. Because the board 34 is secured to the base 20 and the lens 50 is secured to the base 20 all of the components are secured together by the engagement of the locking members 64 with the apertures 68. To properly align the board 34 with the end cap 60 and to provide a secure engagement between the end cap 60 and the other components, an alignment member 70 may extend from the end cap that engages the chamber 35 formed between the base 20 and the board 34. In this manner the board 34 is trapped between the fingers 64 and the alignment member 70, and the base 20 is trapped between the alignment member 70 and the wall of the end cap 60. These members may be dimensioned such that a friction fit is created between the members to further secure the end caps 60 to the lens 50, LED board 34, and base 20. Other arrangements of a snap-fit connector may be used. For example a fewer or greater number of locking members may be used. The deformable locking members may be formed on the board and the apertures or other mating receptacles may be formed on the end caps. Both of the mating members may be deformable. Rather than using deformable members the locking members may comprise rigid members that are biased to the locking position by separate springs. The specific configuration of the mating snap-fit members may change from that shown. Moreover, the locking members may engage the base 20 and/or lens 50 rather than or in addition to engaging the board 34. While use of a snap-fit connector provides a simple assembly method that does not require additional tools, assembly steps or fasteners, the end caps 60 may be connected to the lens 50, LED board 34, and base 20 using other connection mechanisms such as separate fasteners, adhesive, or the like.

The end wall 63 defines an aperture 72 for receiving the electrical connector of the lamp. The electrical connector comprises a rotating control member 76 that is fixed in the aperture 72 such that the control member 76 may rotate relative to the end cap 60 but is otherwise fixed to the end cap. In one embodiment the rotating control member 76 includes deformable fingers 78 that extend into the aperture 72 and have locking portions 80 that engage the interior edge of the aperture 72. The fingers 78 are dimensioned such that the end wall 63 is trapped between the locking portions 80 and the body 82 of the control member 76 but the control member 76 is free to rotate relative to the end wall 63. In one embodiment the fingers 78 may deform to allow the locking portions 80 to be inserted into the aperture 72. Once the locking portions 80 are positioned inside of the aperture 72 the fingers 78 return to the undeformed state where the locking portions 80 are disposed behind the end wall 63. Other mechanisms for mounting the rotating member to the end caps may also be used. The rotating control member 76 may be provided with a protruding area 84 that extends beyond the wall of the end cap 60 and that may be easily accessed by a user to rotate the control member 76 during installation of the lamp as will be described. The protruding area 84 may be knurled to facilitate the rotation of the control member 76.

The control member 76 rotates a plate 90 that carries a pair of pins 94. The plate 90 is mounted for rotation with the control member 76 such that rotation of the control member 76 rotates plate 92. The pins 94 are mounted in apertures 96 in the plate 90 and are positioned and dimensioned such that the pins 94 on opposite ends of the lamp 100 are able to engage the tombstone connectors 10. In one embodiment the plate 92 includes deformable fingers 98 that extend into the aperture 101 formed in the control member 76. The fingers 98 and have locking portions 102 that engage the interior edge of the aperture 72. The fingers 98 are dimensioned such that the control member 76 is trapped between the plate 90 and end cap 60. The fingers 98 extend between the fingers 78 of control member 76 such that the control member 76 and the plate 92 are constrained to rotate together. In one embodiment the fingers 98 may deform to allow the locking portions 102 to be inserted into the aperture 72. Once the locking portions 102 are positioned inside of the aperture 72 the fingers 98 return to the undeformed state where the locking portions 102 are disposed behind the end wall 63. Other mechanisms for mounting the control member and plate to the end caps may also be used. While the plate 90 and control member 76 are disclosed as being separate members that are connected for simultaneous rotation these members may be combined in a single unitary member.

The pins 94 extend through apertures 96 such that the pins communicate with the interior of the lamp. The pins may be fixed to the plate 92 using any suitable connection mechanism including a press fit, adhesive, mechanical connector or the like. Conductors 104 are electrically coupled to the pins and to electrical contacts 106 formed on or with the LED board 34 to complete the electrical path between the pins 94 and the LED board 34. The conductors 104 may comprise wires, ribbons or the like that are soldered or otherwise electrically coupled to the pins 94 and to contacts 106 on the LED board 34. In some embodiments a single pin may be used to complete the electrical connection where the second pin may be used only to provide physical support for the lamp in the tombstone connectors.

The typical tombstone connector 10 comprises a linear slot 200 that communicates with the exterior of the connector through an opening 202. A circular slot 204 communicates with the linear slot 200 such that the linear slot bisects the circular slot. An electrical contact is located in each half of the circular slot 204 where the contacts are connected in the electrical path. The pins 94 are positioned on the lamp 100 such that they can be inserted through opening 202 into the linear slot 200 where the pins 94 are disposed at the intersection of the circular slot 204 and the linear slot 200. The plate 90 can then be rotated to move the pins 94 in the circular slot 204 such that one pin engages each one of the electrical contacts of tombstone connector 10.

Because the lamp of the invention is intended to be used as a replacement for standard fluorescent tubes the pins 94 are positioned in the same relative location as the pins on a standard fluorescent tube such that the lamp of the invention may be used in standard fluorescent housings and with standard tombstone connectors. The length of the lamp 100 of the invention may also be dimensioned to fit standard fluorescent bulb length housings such that the enclosure extends between the tombstone connectors 10 with the pins 94 extending parallel to the longitudinal axis of the lamp. In some embodiments where the lamp 100 of the invention is used to replace a standard 1 inch fluorescent tube the lamp of the invention may have a height of approximately 1 inch and a width of 1-2 inches.

To assemble the lamp of the invention, an LED board 34 is populated with LEDs 32. The LED board 34 is inserted into the C-channels 40, 42 of the base 20 such that the board 34 is secured to and supported by the base 20. In addition to supporting the board 34 the base 20 also functions as a heat sink to dissipate heat generated by the LEDs 32 to the ambient environment. The wires 104 from the end caps are then soldered or otherwise electrically coupled to the electrical path on the board 34. The lens 50 is mounted to the base 20 by inserting the flanges 52, 54 of the lens into the mating C-channels 56, 58 on the base 20. The flanges may be slid into the C-channels or the lens may be deformed and snap-fit into the C-channels. The first and second end caps 60 may be slid over the lens 50, board 34 and base 20 to engage the snap-fit connector to complete the lamp.

Figure 4:
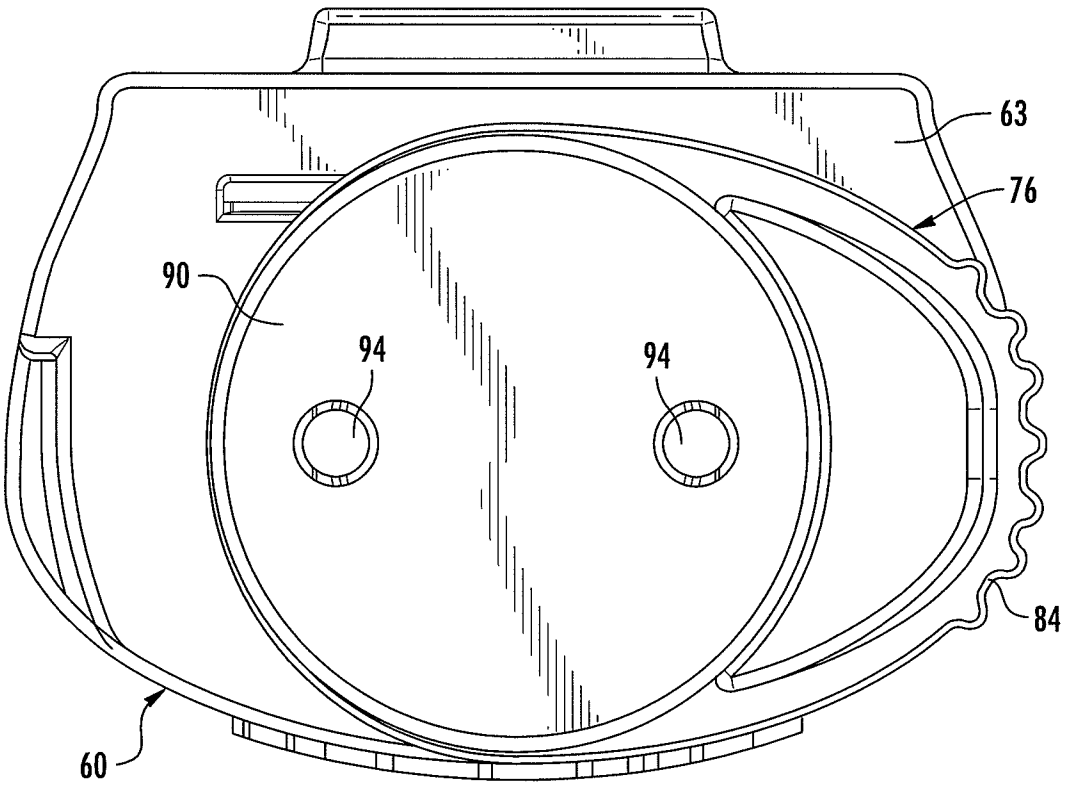
FIG. 4 is an end view of the LED lamp of FIG. 1 in a first position.
Figure 5:
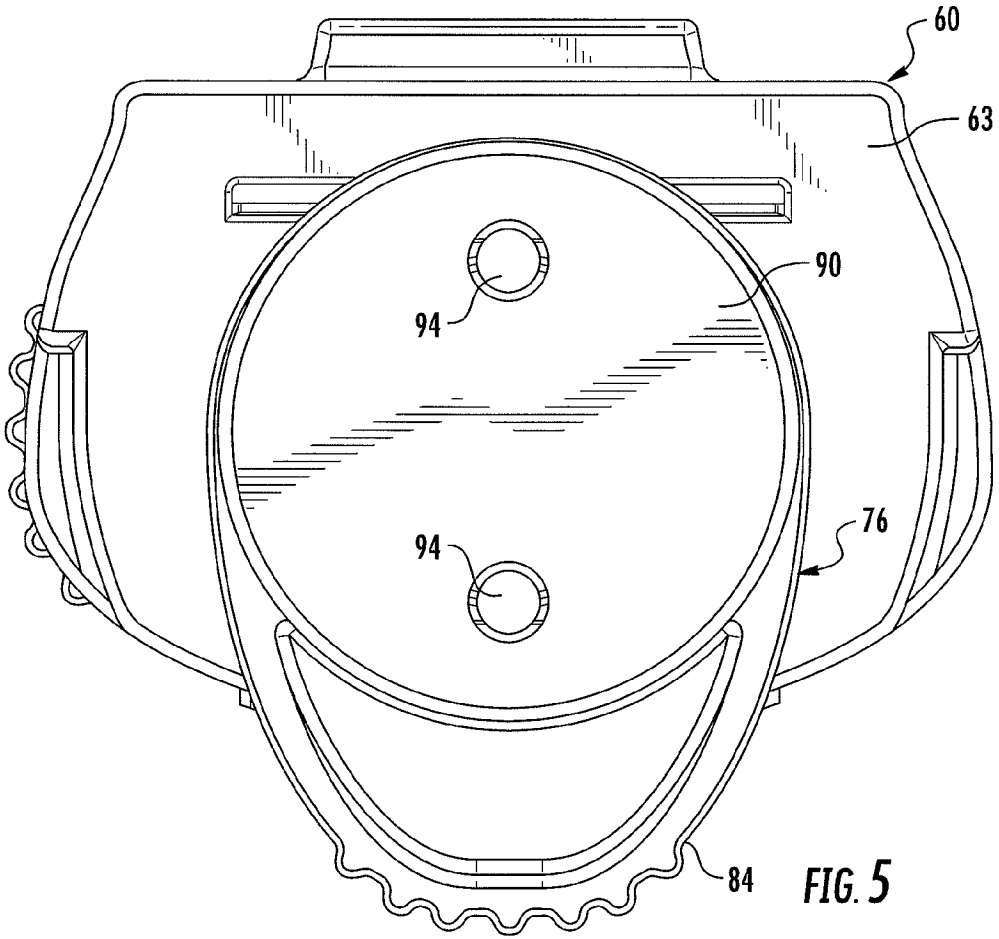
FIG. 5 is an end view of the LED lamp of FIG. 1 in a second position.
Figure 6:
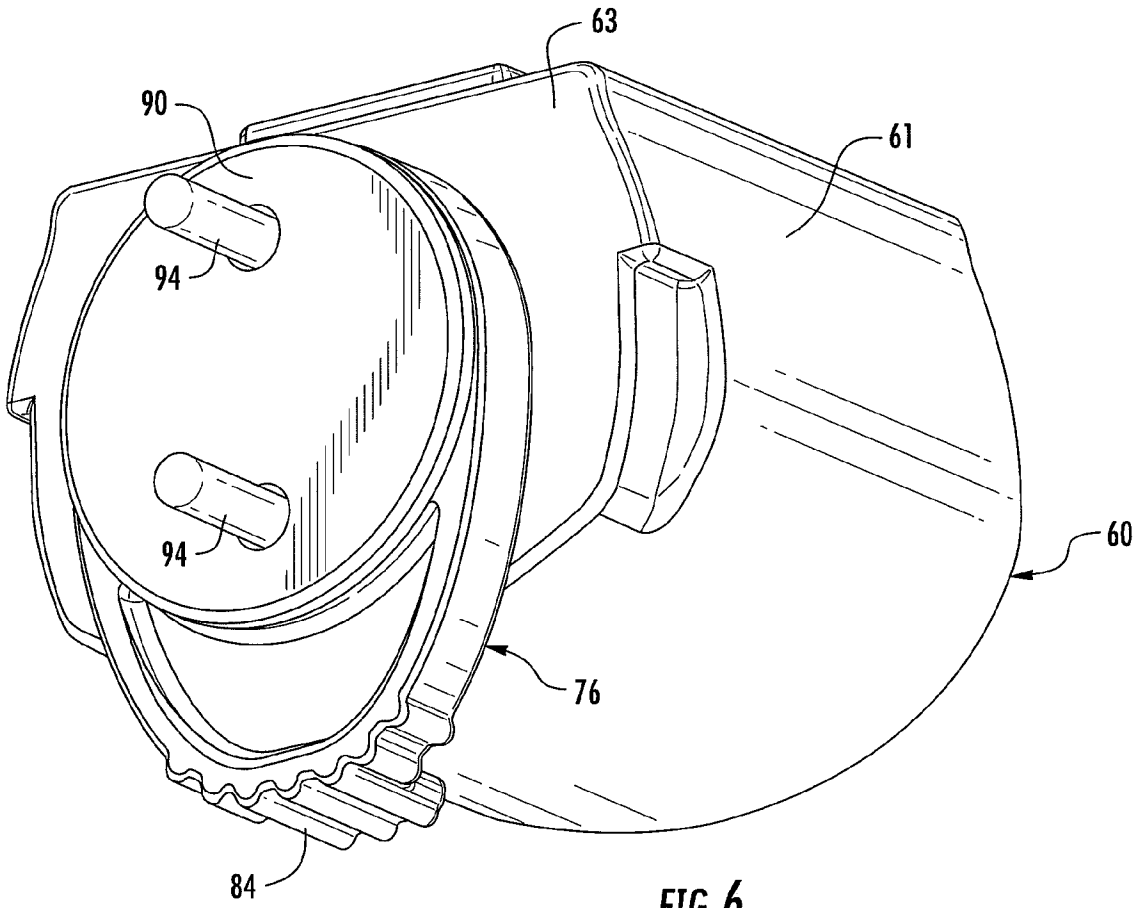
FIG. 6 is a perspective view of an embodiment of an end cap of the LED lamp of FIG. 1.
Figure 7:
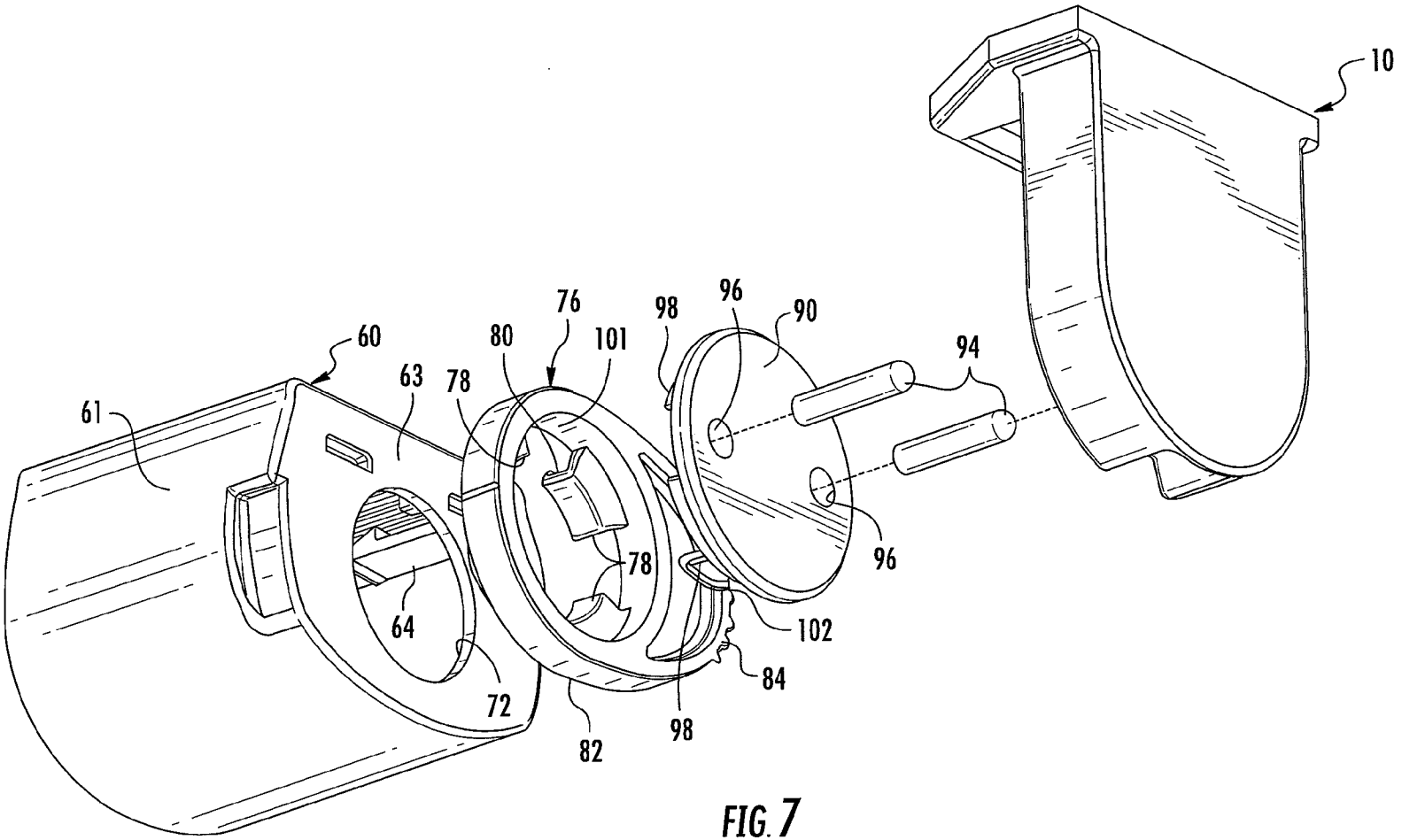
FIG. 7 is a perspective exploded view showing the embodiment of a LED lamp of FIG. 1.

To retrofit an existing fluorescent fixture, the existing fluorescent tubes 13 are removed from the fixture housing. The control members 76 are rotated relative to the enclosure such that the pins 94 are aligned along a line perpendicular to the base 20 as shown in FIGS. 5 and 6, and in the right hand connector of FIG. 1. In a typical ceiling mount fixture the control member 76 is rotated such that the pins are aligned generally vertically. The lamp 100 is inserted into the housing 4 such that the pins 94 are inserted into the linear slot 200 of the tombstone connectors 10. Once the lamp 100 is properly positioned in the housing and the pins 94 are seated in the tombstone connectors 10, the control member 76 is rotated 90 degrees relative to the enclosure by the user to rotate the plate 90 and pins 90 degrees (as shown in FIG. 4 and the left hand connector of FIG. 1.). The pins rotate in the in the circular slots 204 of the tombstone connectors 10. The enclosure remains stationary during the rotation of the pins. The pins 94 are rotated to engage the existing electrical contacts in the tombstone connectors 10. Because the pins are rotatable relative to the enclosure, the enclosure may be rotated relative to the pins after the lamp is mounted in the housing to provide more directional light.

While the housing 4 and LED lamp 100 have been described herein as a retrofit of a traditional fluorescent light, the LED lamp 100 and the assembly method described herein may also be used to make new LED based fixtures. An LED lamp 100 as described herein may be manufactured as a complete subassembly and may be attached to a new housing 4 as described to create a new fixture.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure at least partially optically transmissive;

at least one LED in the enclosure operable to emit light through the enclosure when energized through an electrical path;

a first pair of pins mounted in a control member, the control member being freely rotatable relative to the enclosure and being in the electrical path.

2. The lamp of claim 1 wherein the enclosure comprises a base, the base being substantially planar.

3. The lamp of claim 2 wherein the base is made of a thermally conductive material and is in thermal communication with the at least one LED.

4. The lamp of claim 1 wherein the enclosure comprises a base, the base dissipating heat from the at least one LED to the exterior of the lamp.

5. The lamp of claim 1 wherein the enclosure comprises a base and a plurality of LEDs where the plurality of LEDs extend for substantially the length of the base.

6. The lamp of claim 1 wherein the enclosure comprises an optically transmissive lens.

7. The lamp of claim 4 wherein the enclosure comprises an optically transmissive lens, the lens being connected to the base.

8. The lamp of claim 7 wherein the lens is connected to the base using a snap-fit connection.

9. The lamp of claim 7 wherein the lens diffuses light emitted by the at least one LED.

10. The lamp of claim 1 wherein the at least one LED is mounted on a LED board that provides physical support for the at least one LED and forms part of the electrical path.

11. The lamp of claim 10 wherein the LED board comprises one of MCPCB, FR4, a flex circuit, and a lead frame.

12. The lamp of claim 10 wherein the enclosure comprises a base, the LED board being mounted on the base.

13. The lamp of claim 12 wherein the base is made of a thermally conductive material and is thermally coupled to the LED board, the base being exposed to the exterior of the lamp.

14. The lamp of claim 1 wherein the enclosure comprises an optically transmissive lens and a base where the lens is connected to the base; and a LED board supporting the at least one LED, the LED board being connected to the base.

15. The lamp of claim 14 wherein the base comprises a first channel and a second channel where the first-channel and the second channel face one another to receive the LED board, and the base comprises a third channel and a fourth channel where the third-channel and the fourth channel receive a first edge and a second edge of the lens.

16. The lamp of claim 1 wherein the enclosure comprises a lens where a portion of the lens extends behind the plane of the at least one LED.

17. The lamp of claim 16 wherein the lens extends at least 180 degrees relative to the at least one LED.

18. The lamp of claim 2 wherein the enclosure comprises a lens where the ratio of a width of a base to the maximum width of the lens is less than 1.

19. The lamp of claim 14 wherein the enclosure comprises a first end cap and a second end cap.

20. The lamp of claim 19 wherein the first end cap and the second end cap receive the base, the LED board and the lens.

21. The lamp of claim 19 wherein the first end cap and the second end cap are connected to at least one of the base, the LED board and the lens.

22. The lamp of claim 14 where the first pair of pins are mounted on a member that is rotatably connected to the first end cap.

23. The lamp of claim 22 wherein a first pair of conductors are electrically coupled to the first pair of pins and to the electrical path.

24. The lamp of claim 22 wherein the first pair of pins are rotatable relative to the enclosure at least 90 degrees.

25. The lamp of claim 1 further comprising a second pair of pins, the second pair of pins being rotatable relative to the enclosure and being in the electrical path.

26. The lamp of claim 25 where the second pair of pins are mounted on a second member that is rotatably connected to the second end cap.

27. The lamp of claim 25 wherein a second pair of conductors are electrically coupled to the second pair of pins and to the electrical path.

28. The lamp of claim 27 wherein the second pair of pins are rotatable relative to the enclosure at least 90 degrees.

29. A method of assembling a LED fixture comprising:

removing a fluorescent tube from a first tombstone connector and second tombstone connector;

providing an LED lamp comprising an enclosure at least partially optically transmissive and at least one LED in the enclosure operable to emit light through the enclosure when energized through an electrical path and a first pair of pins and a second pair of pins mounted to the enclosure, the first pair of pins and the second pair of pins being in the electrical path;

positioning the LED lamp between the tombstone connectors such that the first pair of pins engage the first tombstone connector and the second pair of pins engage the second tombstone connector;

holding the enclosure stationary and rotating the first pair of pins and the second pair of pins relative to the enclosure.

30. A lamp comprising:

an enclosure at least partially optically transmissive wherein the enclosure comprises a base, the base being substantially planar and a lens where a width of the lens is greater than a width of the base;

at least one LED in the enclosure operable to emit light through the enclosure when energized through an electrical path;

a first pair of pins being rotatable relative to the enclosure and being in the electrical path.

31. A lamp comprising:

an enclosure at least partially optically transmissive wherein the enclosure comprises a base, the base being substantially planar and a lens having a height where the base is disposed in the bottom quarter of the height of the lens;

at least one LED in the enclosure operable to emit light through the enclosure when energized through an electrical path;

a first pair of pins being rotatable relative to the enclosure and being in the electrical path.

32. A lamp comprising:

an enclosure at least partially optically transmissive wherein the enclosure comprises an optically transmissive lens and a base where the lens is connected to the base;

at least one LED in the enclosure operable to emit light through the enclosure when energized through an electrical path and a LED board supporting the at least one LED, the LED board being connected to the base;

a first pair of pins being rotatable relative to the enclosure and being in the electrical path;

wherein the enclosure comprises a first end cap and a second end cap connected to at least one of the base, the LED board and the lens using a snap-fit connection.

33. The lamp of claim 32 wherein the first end cap and the second end cap are provided with a deformable member that engages one of the LED board, the lens and the base.

34. The lamp of claim 33 wherein the deformable member engages the LED board when the LED board is inserted into the first end cap and the second end cap.

* * * * *